United States Patent [19]

Irro

[11] Patent Number: 4,479,729

[45] Date of Patent: Oct. 30, 1984

[54] STUFFING CASSETTE WITH EXTERNAL DRIVE

[75] Inventor: Otmar Irro, Feldkirchen, Fed. Rep. of Germany

[73] Assignee: Siemens Aktiengesellschaft, Berlin & Munich, Fed. Rep. of Germany

[21] Appl. No.: 502,512

[22] Filed: Jun. 9, 1983

[30] Foreign Application Priority Data

Jul. 5, 1982 [DE] Fed. Rep. of Germany ..... 3225112

[51] Int. Cl.[3] ..... B41J 32/02

[52] U.S. Cl. ..... 400/196.1; 226/118

[58] Field of Search ..... 400/194, 195, 196, 196.1, 400/207, 208, 208.1; 226/197, 198, 199, 118; 242/197, 198, 199

[56] References Cited

U.S. PATENT DOCUMENTS

| | | | |
|---|---|---|---|
| 3,342,431 | 9/1967 | Mouissie | 242/197 |
| 3,758,012 | 9/1978 | Bon er et al. | 226/168 |
| 3,900,172 | 8/1975 | Kamaya | 242/198 |
| 3,945,582 | 3/1976 | Yagi et al. | 400/196 X |
| 4,046,247 | 9/1977 | LaSpesa et al. | 400/196 |
| 4,053,042 | 10/1977 | Hess | 400/196 |
| 4,212,420 | 7/1980 | Helinski | 226/118 |
| 4,325,646 | 4/1982 | Sasaki | 400/196.1 |

FOREIGN PATENT DOCUMENTS

| | | | |
|---|---|---|---|
| 2148950 | 4/1973 | Fed. Rep. of Germany . | |
| 7726685 | 1/1978 | Fed. Rep. of Germany . | |
| 57-27778 | 2/1982 | Japan | 400/207 |
| 2077227 | 12/1981 | United Kingdom | 400/196.1 |

OTHER PUBLICATIONS

Stuffed Take-Up with Separator, S. A. Okeuoglu, IBM ® Technical Disclosure Bulletin, vol. 23, No. 11, p. 5004, Apr. 1981.

Door Opening and Ejection Lever for Magnetic Media Cartridges, M. E. Richard, IBM ® Technical Disclosure Bulletin, vol. 26, No. 7B, pp. 3812–3813, Dec. 1983.

*Primary Examiner*—Edgar S. Burr

*Assistant Examiner*—Moshe I. Cohen

*Attorney, Agent, or Firm*—Hill, Van Santen, Steadman & Simpson

[57] ABSTRACT

An interchangeable stuffing cassette for a cassette acceptance means of a typewriter or printer, has a stuffing space and a ribbon which is transported out of and into the stuffing space by means of an external drive. Outside of the cassette acceptance means, the stuffing space is closed by a flap. A slot by means of which the ribbon is stretched tight is situated in the flap. Upon insertion into the cassette acceptance means, the flap is pivoted to the side, whereby the stuffing space is opened and the ribbon is released.

6 Claims, 2 Drawing Figures

STUFFING CASSETTE WITH EXTERNAL DRIVE

BACKGROUND OF THE INVENTION

The invention relates to a stuffing cassette for use in a typewriter or printer wherein a stuffing space is provided in the cassette. A ribbon is transported out of the stuffing space at one point and at another point the ribbon is stuffed into the space by an external drive.

Cassettes containing a ribbon required for printing on the recording medium are employed in recent typewriters and similar devices.

A variety of embodiments of these ribbon cassettes are known. The ribbon in the cassette can be wound on a fixed or displaceable supply reel from which it is transported to a fixed or displaceable takeup reel. Due to the employed reels, guides and the drive, these ribbon cassettes which, of course, are thrown away after use, are relatively costly.

Another known ribbon cassette is known as the stuffing cassette. With this type of cassette, the ribbon is accommodated in a so-called stuffing space. It is withdrawn from this space at one side and is stuffed in at the other side by a drive. In the simplest case, the drive consists of two drive capstans between which the ribbon is transported.

There are two types of designs for stuffing cassettes, namely with and without separate drive. The unit without separate drive employs external drive. The stuffing cassette with external drive is therefore cheaper but has the disadvantage that the dangling ribbon must be manually inserted in the drive of the cassette acceptance means. The danger that the hands of the operator will be dirtied with ink therefore exists.

SUMMARY OF THE INVENTION

An object of the invention is to specify a stuffing cassette with external drive wherein the ribbon is largely protected against contact when inserting the stuffing cassette into the cassette acceptance means of the typewriter.

This object is inventively achieved by means of providing a combined gripping and closing device for stretching and positioning the ribbon and for closing the stuffing space prior to loading the cassette in a cassette acceptance means of the typewriter or printer. After insertion, the ribbon is released and the stuffing space is opened.

A particular advantage of the inventive stuffing cassette is that contact with the ribbon is also largely excluded when removing the ribbon from the typewriter.

DESCRIPTION OF THE PREFERRED EMBODIMENTS

Figure 1:
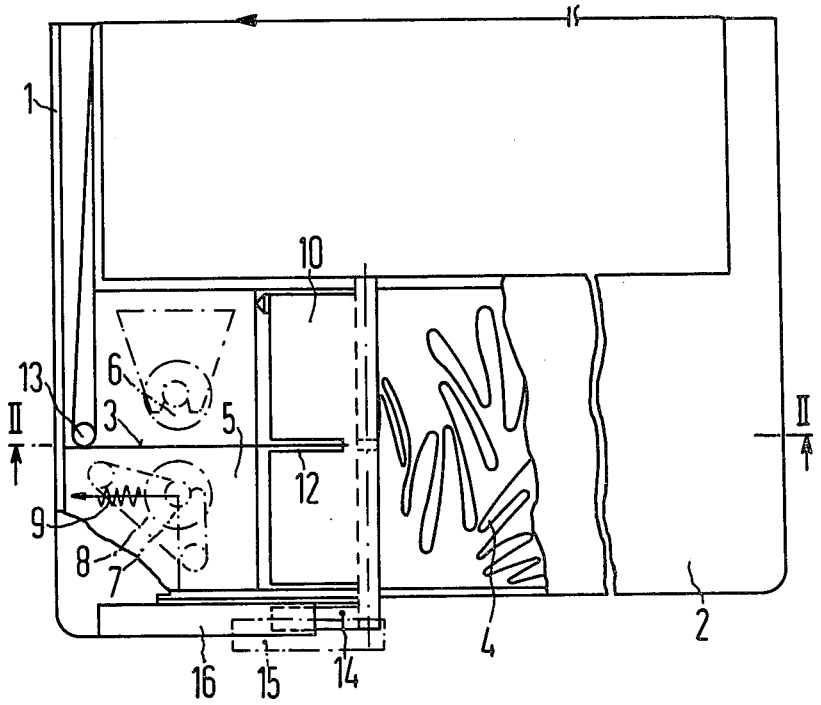
FIG. 1 illustrates a stuffing cassette in plan view.

A stuffing cassette consisting of a lower part 1 and a cover 2 is illustrated in the Figures. During write mode when the cassette is inserted in the typewriter, a ribbon 3 is withdrawn from the stuffing space 4 at the one side (at the right side in FIG. 1, although the specific point of withdrawal is not shown) and is stuffed in at the other side (at the left side in FIG. 1). An opening 5 through which the drive of the typewriter projects into the stuffing cassette is situated in the lower part 1. The drive comprises for example, a stationarily seated capstan idler 6 and a movably seated capstan idler 7 which are seated on a drive rocker 8.

The drive rocker 8 has two stable positions, a disengaged position and an applied position, which are assumed due to a spring 9, for example a dead center spring. A tension spring is illustrated here as the dead center spring but a leaf spring or torsion spring is also possible. In the applied position, the two capstan idlers 6, 7 are pressed against one another by the spring power and the ribbon 3 lying between them is transported. The drive rocker 8 can be pivoted from one position into the other either manually or automatically.

Figure 2:
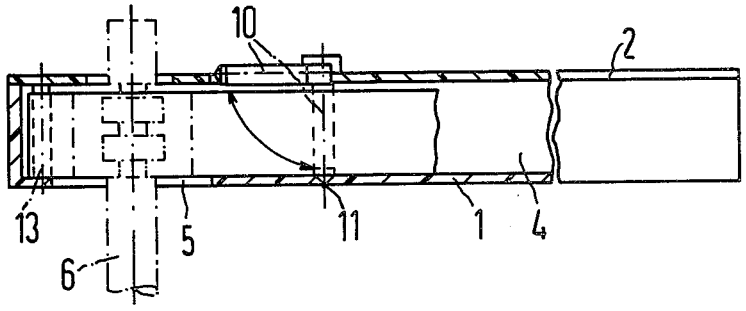
FIG. 2 illustrates a section through the stuffing cassette in an elevational view.

Generally, the stuffing cassette passes through three states. The first state is the so-called new state. The new state is the state after factory manufacture and prior to insertion in a cassette typewriter receiving device; i.e., the state in which the stuffing cassette is not yet used. The flap or lid 10 is here pivoted down and in front of the stuffing chamber 4 (illustrated in broken lines in FIG. 2), the typewriter ribbon 3 being fixed and positioned in the flap 10 through the slot 12. The ribbon in the stuffing chamber 4 cannot bulge out of the chamber in this state. In the second state, the stuffing cassette is inserted in the cassette receiving device. Upon insertion the flap is pivoted away from the stuffing chamber (illustrated in heavy lines in FIG. 2), the ribbon bulges somewhat out of the stuffing chamber, and the drive or transport (in arrow direction FIG. 1) is released to engage the tape. The stuffing cassette is later in a third state when it has again been removed from the cassette receiving device. The flap is here then again pivoted in front of the stuffing chamber. In this case, however, the ribbon is no longer disposed in the slot; on the contrary, it is clamped in between the flap and the lower portion 1 of the stuffing cassette.

Now the three states will be described more specifically. In its new state, the stuffing space 4 is closed at the side at which the ribbon 3 is stuffed in. The pivotably seated flap 10 is employed, for example, for the purpose of closing, this being latched in this condition in a catch notch 11 situated in the lower part 1. When the stuffing cassette is inserted in a cassette acceptance means (not illustrated in greater detail here), the stretched ribbon 3 is guided between the capstan idlers 6, 7 of the drive. A slot 12 situated in the flap 10 serves the purpose of stretching the ribbon 3 between the position pin 13 and slot which is sufficiently narrow so as to impede exit of the ribbon from the stuffing chamber and permit the stretching. The slot 12 is only effective as long as the flap 10 keeps the stuffing space 4 closed. A pin 13 which holds the ribbon 3 in the position necessary for insertion into the drive is disposed, for example, in the lower part 1 at the side lying opposite the slot 12.

The flap 10 can be of any desired material and can have any desired shape; it need merely hold the ribbon 3 stretched and the stuffing space 4 closed in the new condition from the factory.

In its operation condition, i.e. inserted in the cassette acceptance means, the flap 10 is pivoted away from the opening of the stuffing space 4 and the ribbon 3 is thereby likewise released. This pivot can occur automatically. For this purpose, the flap 10 has an arm 14 and the cassette acceptance means has a stop at that location so that the flap 10 is pivoted away when the stuffing cassette is inserted.

When removing the stuffing cassette, as little ribbon 3 as possible should protrude from it. For this purpose, for example, a spring 16 is secured to the cover 2 such that the flap 10 is pivoted by the spring power in front of the opening of the stuffing space 4 when the stuffing cassette is removed from the cassette acceptance means. The ribbon 3 is thereby clamped and an escape of the ribbon is prevented. Differing from its new condition, the ribbon 3 is therefore not clamped in the slot 12 of the flap 10 but, rather, between the flap 10 and the lower cassette part 1. A pointed tab which is resilient can also be employed at the cover 2 as the spring 16.

Simple and clean insertion or replacement of the ribbon cassette in a typewriter is possible for the operator given the stuffing cassette of this invention.

Although various minor changes and modifications might be proposed by those skilled in the art, it will be understood that I wish to include within the claims of the patent warranted hereon all such changes and modifications as reasonably come within my contribution to the art.

I claim as my invention:

1. An interchangeable stuffing cassette for loading into a cassette acceptance means of a typewriter or printer, comprising:

a stuffing space means comprising a chamber with an open side for storing a ribbon which is pulled out of the chamber at a given location and is stuffed back into the chamber through said open side by an external drive; and a combined gripping and closing device means comprising a flap with a slit positioned at the chamber opening for stretching the ribbon tight with the ribbon in the slit and for closing with the flap the opening in the chamber of the stuffing space means prior to loading the cassette in the cassette acceptance means, said combined gripping and closing device means including actuating means for opening the flap so as to release the ribbon from the slit and open the chamber of the stuffing space means when the cassette is loaded in the cassette acceptance means.

2. A stuffing cassette according to claim 1 wherein a latch means is provided for latching the flap outside of the cassette acceptance means.

3. A stuffing cassette according to claim 1 wherein an arm means is secured to the flap for switching the flap away from the opening of the stuffing space means chamber when the stuffing cassette is inserted into the cassette acceptance means, the arm means being pivoted away by means of a stop disposed at the cassette acceptance means.

4. A stuffing cassette according to claim 1 wherein a spring element means is provided for pivoting the flap in front of the opening of the stuffing space means chamber when the stuffing cassette is removed from the cassette acceptance means, and the flap being dimensioned so that the ribbon is simultaneously pinched between a portion of the cassette and the flap.

5. A stuffing cassette for use in a typewriter or printer having a drive for ribbon contained in the stuffing cassette, comprising:

a stuffing space means comprising a chamber with an open side into which the ribbon is stuffed by the drive of the typewriter or printer;

a flap hingeably connected at the open side of the stuffing space, said flap having a slot positioned to receive the ribbon prior to initial use;

the flap having means cooperable with a member associated with the typewriter or printer such that prior to loading the flap is in a closed position which closes off the open side of the stuffing space and when loaded the flap is in an open position such that the stuffing space is open;

positioning means for the ribbon which cooperates with the flap slot when the ribbon is in the slot such that prior to loading the ribbon is positioned to be freely received and aligned with respect to the drive of the typewriter or printer when the cassette is loaded, the slot being dimensioned such that the ribbon is released from the slot after insertion and when the flap is in an open position; and the flap being dimensioned such that after removal of the cassette from the typewriter or printer the ribbon is pinched between the closed flap and a portion of the cassette.

6. A stuffing cassette according to claim 5 wherein spring means are provided for biasing the flap to the closed positon when the cassette is not loaded in the typewriter or printer.

* * * * *